US008429914B2

(12) United States Patent
Gashi et al.

(10) Patent No.: US 8,429,914 B2
(45) Date of Patent: Apr. 30, 2013

(54) FUEL INJECTION SYSTEM

(75) Inventors: Sara Gashi, London (GB); Nickolaos Pilatis, Warrington (GB)

(73) Assignee: Rolls-Royce PLC (GB)

( * ) Notice: Subject to any disclaimer, the term of this patent is extended or adjusted under 35 U.S.C. 154(b) by 975 days.

(21) Appl. No.: 12/493,870

(22) Filed: Jun. 29, 2009

(65) Prior Publication Data

US 2010/0011772 A1 Jan. 21, 2010

(30) Foreign Application Priority Data

Jul. 16, 2008 (GB) ..... 0812905.8

(51) Int. Cl.
*F02C 1/00* (2006.01)
*F02G 3/00* (2006.01)

(52) U.S. Cl.
USPC ..... 60/748; 60/737; 60/743; 239/402; 431/9; 431/181

(58) Field of Classification Search ..... 60/748, 60/743, 737; 239/402, 403, 404; 431/9, 431/181, 182
See application file for complete search history.

(56) References Cited

U.S. PATENT DOCUMENTS

| | | | | |
|---|---|---|---|---|
| 4,260,367 | A * | 4/1981 | Markowski et al. | 431/353 |
| 5,505,045 | A * | 4/1996 | Lee et al. | 60/748 |
| 6,272,840 | B1 * | 8/2001 | Crocker et al. | 60/776 |
| 8,225,612 | B2 * | 7/2012 | Oda et al. | 60/748 |
| 2002/0011064 | A1 * | 1/2002 | Crocker et al. | 60/39.06 |
| 2005/0097889 | A1 * | 5/2005 | Pilatis et al. | 60/743 |

FOREIGN PATENT DOCUMENTS

| | | |
|---|---|---|
| EP | 1413830 | 7/2006 |
| EP | 1750056 | 2/2007 |
| GB | 2439097 | 12/2007 |

* cited by examiner

*Primary Examiner* — William H Rodriguez
(74) *Attorney, Agent, or Firm* — McCormick, Paulding & Huber LLP

(57) ABSTRACT

A fuel injection system is provided for a gas turbine, comprising a mains airblast fuel injector having an annular shape, and inner and outer mains swirlers for swirling air past the mains airblast fuel injector. The inner and outer mains swirlers are concentric with the mains airblast fuel injector and are located radially inwardly and radially outwardly of the mains airblast fuel injector, respectively. The mains airblast fuel injector and the inner and outer mains swirlers are so arranged as to produce a fuel spray stream which expands from the mains airblast fuel injector and has a double flame front. The double flame front comprises flame fronts on both the radially inner and radially outer surfaces of the fuel spray stream.

8 Claims, 6 Drawing Sheets

FUEL INJECTION SYSTEM

CROSS REFERENCE TO RELATED APPLICATION

This application is entitled to the benefit of British Patent Application No. GB 0812905.8, filed on Jul. 16, 2008.

FIELD OF THE INVENTION

The present invention relates to fuel injection systems and particularly to fuel injection systems for gas turbine engines.

BACKGROUND OF THE INVENTION

Fuel injection systems deliver fuel to the combustion chamber of an engine, where the fuel is thoroughly mixed with air before combustion. One form of fuel injection system well-known in the art is a fuel spray nozzle. Fuel spray nozzles atomise the fuel to ensure its rapid evaporation and burning when mixed with air. However, ensuring efficient combustion of the fuel can be difficult because the velocity of the air stream within the combustion chamber creates a hostile environment for the flame, while the short length of the combustion system means there is little time for burning to occur.

An airblast atomiser nozzle is a type of fuel spray nozzle in which fuel delivered to the combustion chamber by a fuel injector is aerated by swirlers to ensure rapid mixing of fuel and air, and to create a finely atomised fuel spray. The swirlers are designed to create a high level of shear in the fuel flow.

Typically, an airblast atomiser nozzle will have a number of swirler circuits. An annular fuel passage between a pair of swirler circuits feeds fuel onto a pre-filming lip. Thus a sheet of fuel is formed that breaks down into ligaments. These ligaments are then broken up into droplets within the shear layers of the surrounding highly swirling air, to form the fuel spray stream that is emitted from the fuel injection system.

Efficient mixing of air and fuel not only results in higher combustion rates, but also reduces the deposition of unburnt hydrocarbons within the combustion chamber and the formation of exhaust smoke resulting from incomplete combustion of the fuel.

There is a continuing need to enhance the efficiency of gas turbine engines of the type used to power jet aircraft or generate electricity, and thus it is desirable to improve the design of fuel injection systems, such as airblast atomiser nozzles, to achieve higher combustion rates.

SUMMARY OF THE INVENTION

In general terms, the present invention may provide a fuel injection system for a gas turbine that is arranged so that multiple flame fronts may be produced on the fuel spray emitted from the system.

In a first aspect, the present invention may provide a fuel injection system for a gas turbine, comprising:

a mains airblast fuel injector having an annular shape;

an inner mains swirler for swirling air past said mains airblast fuel injector, said inner mains swirler being concentric with said mains airblast fuel injector and being located radially inward of said mains airblast injector; and an outer mains swirler for swirling air past said mains airblast fuel injector, said outer mains swirler being concentric with said mains airblast fuel injector and being located radially outward of said mains airblast injector;

wherein said mains airblast fuel injector, said inner mains swirler and said outer mains swirler are so arranged as to produce a fuel spray stream which expands from the mains airblast fuel injector, an inner flame front being formed on a radially inner surface of said fuel spray stream, and a radially-spaced outer flame front being formed on a radially outer surface of said fuel spray stream.

Thus, a double flame front is formed on the fuel spray stream. This is in contrast to known fuel injection systems which only produce a flame front on the radially inner surface of the fuel spray stream. As a result of this double flame front, the combustion efficiency of the fuel injection system may be improved and the amount of unburnt fuel reduced. Thus, the overall efficiency of the gas turbine may be increased, and there may be a reduction in the amount of unburnt hydrocarbons deposited on the inner surfaces of the combustion chamber and in the amount of exhaust smoke emitted.

Typically, the fuel spray stream is frustoconical in shape, and is centred on the central axis of the mains airblast fuel injector.

The outer mains swirler of this aspect of the invention may be bounded at its outermost radial extent by an outer wall. In this case, the outer wall is concentric with the mains airblast fuel injector, and a portion of the outer wall extends beyond the outer mains swirler to lie downstream of the mains airblast fuel injector. This portion of the outer wall may taper radially inwardly in the downstream direction.

By providing an outer wall having a tapered portion that lies downstream of the mains fuel injector, a narrower frustoconical fuel spray stream may be produced that has a greater axial velocity than is the case for known fuel injection systems. As a result, the radially outer surface of the fuel spray stream may experience higher shear than in known fuel injection systems, and may thus evaporate faster and start to react earlier. Effectively, the shape of the outer wall may result in more efficient atomisation of the outer layer of the fuel spray stream.

Typically, the fuel injection system of this aspect of the invention is mounted in an upstream wall of a combustion chamber.

The outer wall of the fuel injection system may have a flared portion as well as a tapered portion. In this case, the flared portion lies downstream of the tapered portion and flares radially outwardly in the downstream direction. In this case, the length of the tapered portion of the outer wall, measured along the central axis of the mains fuel injector, from the aft end of the mains fuel injector to the aft end of the tapered portion, is preferably greater than or equal to the length of the flared portion, measured along the central axis of the mains fuel injector. It is also preferred that the taper of the tapered portion of the outer wall is more gradual than the flare of the flared portion of the outer wall.

Preferably, however, the tapered portion of the outer wall extends to the upstream wall of the combustion chamber. Thus there may be no flared portion downstream of the tapered portion. By adopting this arrangement, enhanced shear at the radially outer surface of the fuel spray stream may be produced, leading to enhanced atomisation of the outer layer of the fuel spray stream.

Indeed, in a second aspect, the present invention may provide a fuel injection system for a gas turbine, comprising:

a mains airblast fuel injector having an annular shape;

an inner mains swirler for swirling air past said mains airblast fuel injector, said inner mains swirler being concentric with said mains airblast fuel injector and being located radially inward of said mains airblast injector; and an outer mains swirler for swirling air past said mains airblast fuel injector, said outer mains swirler being concentric with said mains airblast fuel injector and being located radially outward of said mains airblast injector, and said outer mains swirler being bounded at its outermost radial extent by an annular outer wall, which is concentric with said mains airblast fuel injector, a portion of said outer wall extending beyond said outer mains swirler to lie downstream of said mains airblast fuel injector;

wherein the portion of said outer wall lying downstream of said mains airblast fuel injector tapers radially inwardly in the downstream direction; and said fuel injection system is mounted in an upstream wall of a combustion chamber, said tapered portion of said outer wall extending to said upstream wall.

The fuel injection system of the second aspect of the invention may also produce enhanced shear and atomisation, and a double flame front.

The following optional features pertain to both aspects of the present invention.

Preferably, in both the first and second aspects of the invention, the tapered portion of the outer wall meets the upstream wall of the combustion chamber at an annular ring that protrudes from the upstream wall in a downstream direction. This allows the tapered portion to extend even further downstream from the mains airblast fuel injector, leading to further enhancement of shear and atomisation.

In effect, the protrusion formed by the annular ring serves to enhance and stabilise a recirculation zone that is formed between the outer surface of the frustoconical mains fuel spray stream and the inner surface of the combustion chamber. This recirculation zone promotes shear and atomisation, and therefore burning, of the outer surface of the fuel spray stream.

The inventors have found that, to produce a double flame front, it is desirable in both the first and second aspects of the invention that the taper of the annular outer wall should end in an angle in the range of from 0° to 50° to the central axis of the wall. That is, on a section through the system, containing the central axis of the fuel injection system, the tapered portion of the outer wall is preferably at an angle in the range of from 0° to 50° to the central axis. More preferably, this angle is in the range of from 5° to 45°. Most preferably, this angle is in the range of from 20° to 40°.

In both the first and second aspects of the invention, it is desirable that the mains outer swirler and mains inner swirler should be co-swirl, rather than counter-swirl, and that the swirl angle of the mains outer swirler should be greater than that of the mains inner swirler. Preferably, the swirl angle of the mains inner swirler is in the range of from 20° to 50° and the swirl angle of the mains outer swirler is in the range of from 40° to 70°.

Preferably, the fuel injection system of both the first and second aspects of the invention should be so configured that the airflow rate through the mains inner swirler is greater than that through the mains outer swirler. More preferably, the airflow rate through the mains inner swirler is from 1.2 to 2 times greater than that through the mains outer swirler.

Preferably, the pre-filming lip is at an angle of from 30° to 60° to the central axis of the fuel injection system. More preferably, this angle is in the range of from 30° to 45°.

In order to increase the efficiency of the fuel injection system, it is preferred that in both the first and second aspects of the invention the distance from the downstream end of the mains airblast fuel injector (i.e. from the point of injection of the mains airblast fuel injector) to the downstream end of the outer wall is sufficiently short to prevent autoignition of the fuel within the outer wall and to prevent mains fuel wetting of the outer wall. Typically this distance is in the range of from 0.5 cm to 2.5 cm. Preferably, this distance is in the range of from 1.0 to 1.5 cm.

Typically, for both the first and second aspects of the invention, the double flame front is achieved during cruise operation. Thus the present invention may assist in the optimisation of cruise efficiency.

Typically, the fuel injection systems of both the first and second aspects of the invention also include a pilot fuel injector lying radially inward of the mains fuel injector. The fuel injection systems may also include a pilot swirler, for swirling air past the pilot fuel injector.

The pilot fuel injector may be an airblast injector that atomises fuel using a rapidly moving airstream. In this case, the pilot swirler may include inner and outer pilot swirlers located inward and outward of the pilot airblast fuel injector. The fuel may be delivered by an annular fuel passage lying between the inner and outer swirlers to a pre-filming lip. This lip supports a sheet of fuel that breaks down into ligaments. These ligaments are then broken up into droplets within the shear layers of the surrounding highly swirling air.

Alternatively, the pilot fuel injector may be a pressure atomiser injector, such as a simplex pressure atomiser fuel injector. In this case, the fuel is atomised by a pressure differential placed across it.

Simplex pressure atomiser pilot fuel injectors have generally been found to be more suitable than pilot fuel airblast injectors for smaller gas turbine engines. This is because they allow the overall radial dimension of the fuel injector to be minimised, which is important for minimising the hole diameter through the engine case for insertion of the fuel injector.

The fuel injection system of the first or second aspect of the invention may be applied to lean direct fuel injectors, small rich burn fuel injectors, or large fuel injectors for industrial, rather than aeronautical applications. The fuel injection system of the first or second aspect of the invention is particularly suitable for use in a lean burn combustor.

In a third aspect, the present invention may provide a gas turbine engine having a fuel injection system according to the first or second aspect of the invention.

DETAILED DESCRIPTION OF THE PREFERRED EMBODIMENTS

Figure 1:
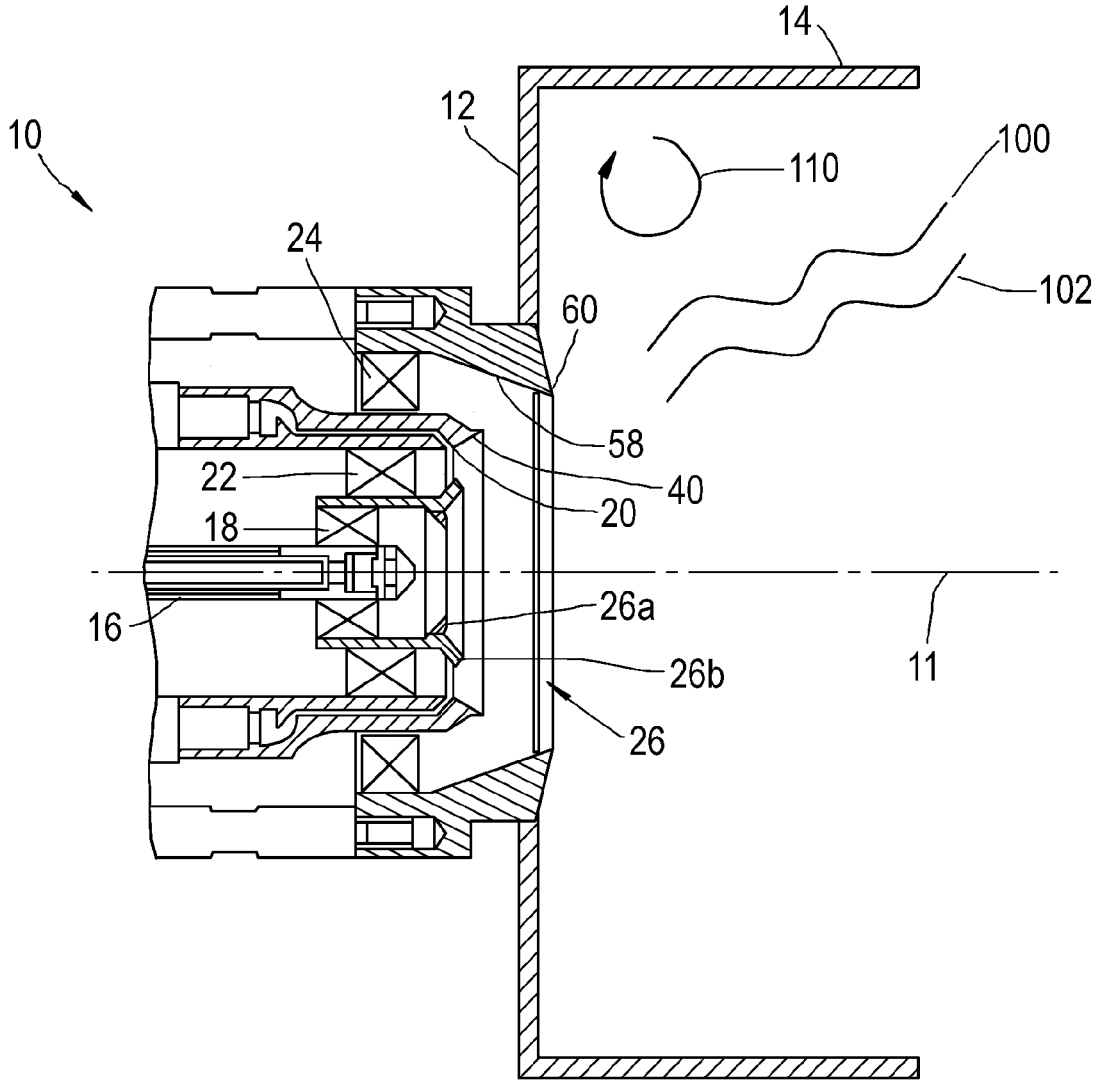
FIG. 1 shows a schematic longitudinal cross-sectional view of a fuel injection system of a first embodiment of the invention.

FIG. 1 shows a schematic view of a first embodiment of a fuel injection system 10 according to the present invention. The fuel injection system 10 is mounted on the upstream wall 12 of a combustion chamber i.e. at the head of a flame tube 14 of the combustion chamber of a gas turbine engine. The surface of the upstream wall 12 that faces in the downstream direction of the fuel injection system is clad with a heatshield.

Fuel injection system 10 has a central axis 11, and is in general circularly symmetrical about this axis. The fuel injection system 10 includes a pilot fuel injector 16. In this embodiment, the pilot fuel injector 16 may be a pressure atomiser fuel injector, such as a simplex pressure atomiser fuel injector, that atomises fuel based on a pressure differential placed across the fuel. The pilot fuel injector 16 shown in FIG. 1 is of this type. Alternatively, the pilot fuel injector may be a pilot fuel airblast injector that atomises fuel using a rapidly moving airstream.

An outer pilot swirler 18 surrounds the pilot fuel injector 16 and is used to swirl air past the pilot fuel injector 16. In general, the outer pilot swirler 18 may be either a radial or an axial swirler, and may be designed to have a vane-like configuration.

The fuel injection system 10 further includes a mains airblast fuel injector 20 which is concentrically located about the pilot fuel injector 16. Inner and outer mains swirlers 22 and 24 are located concentrically inward and outward of the mains airblast fuel injector 20. The pilot fuel injector 16 and the mains fuel injector 20 may also be described as a primary fuel injector 16 and a secondary fuel injector 20, respectively.

As will be understood by those skilled in the art, an airblast fuel injector such as injector 20 provides liquid fuel to an annular outlet which allows the fuel to flow in an annular film along atomiser filmer lip 40 leading to the aft end of the injector. The annular film of liquid fuel is then entrained in the much more rapidly moving and swirling air streams passing through inner mains swirler 22 and outer mains swirler 24. These air streams cause the annular film of the liquid fuel to be atomised into small droplets, thus creating a hollow frustoconical mains fuel spray stream flaring radially outwards in the downstream direction. Preferably, the design of the mains airblast fuel injector 20 is such that the mains fuel is entrained approximately midstream between the airstreams exiting the inner mains swirler 22 and the outer mains swirler 24.

The pilot fuel spray stream emitted by the pilot fuel injector 16 lies within the hollow frustoconical mains fuel spray stream and flares radially outwards in the downstream direction.

In general, the inner and outer mains swirlers 22,24 may be either radial or axial swirlers, and may be designed to have a vane-like configuration.

The vane angles of the outer mains swirler 24 are preferably co-swirl with reference to the vane angles of the inner mains swirler 22. The swirl angle of the outer pilot airflow is preferably counter-swirl with respect to the swirl direction of the inner pilot airflow; it is also preferably counter-swirl with respect to the swirl direction of the inner and outer mains swirler airflow.

An air splitter 26 is located between the pilot swirler 18 and the inner mains swirler 22. The geometry and location of the air splitter 26 is such that the air splitter divides a pilot air stream exiting the outer pilot swirler 18 from a mains air stream exiting the inner and outer mains swirlers 22 and 24. Thus, a bifurcated recirculation zone is created between the pilot air stream and the mains air stream. The pilot fuel spray stream lies within the mains fuel spray stream and the two streams are separated by this bifurcated recirculation zone, which is a generally hollow frustoconical aerodynamic structure defining a volume in which there is some axially rearward flow.

The pilot fuel spray stream and the mains fuel spray stream may merge downstream of the air splitter, as the pilot air stream is drawn into the mains air stream. Thus, a single fuel spray stream may be formed downstream of the fuel injection system 10.

In the present embodiment, the air splitter 26 has a tapered portion 26*a* and a flared portion 26*b*. The tapered portion 26*a* is adjacent to the outer pilot swirler 18 and tapers inwardly in the downstream direction. The flared portion 26*b* is adjacent to the inner mains swirler 22 and flares outwardly in the downstream direction. However, differently-shaped air splitters may be used, such as that described in U.S. Pat. No. 6,272,840B2, in which a tapered portion is provided, but no flared portion.

The outer dimensions of the frustoconical mains fuel spray stream are determined by a number of factors, including the turning angle of the swirlers, the angle of the prefilmer and the shape of an outer wall 58.

This outer wall 58 is an annular wall that bounds the outer radial extent of the outer mains swirler 24 and also extends downstream of the mains airblast injector 20. The outer wall 58 faces inwards towards the central axis 11 of the fuel injection system 10 and tapers in the downstream direction all the way to its aft end. The outer wall 58 meets the upstream wall 12 of the combustion chamber at a raised ring 60, the raised ring 60 protruding from the upstream wall 12 into the combustion chamber, that is, in a downstream direction.

Figure 6:
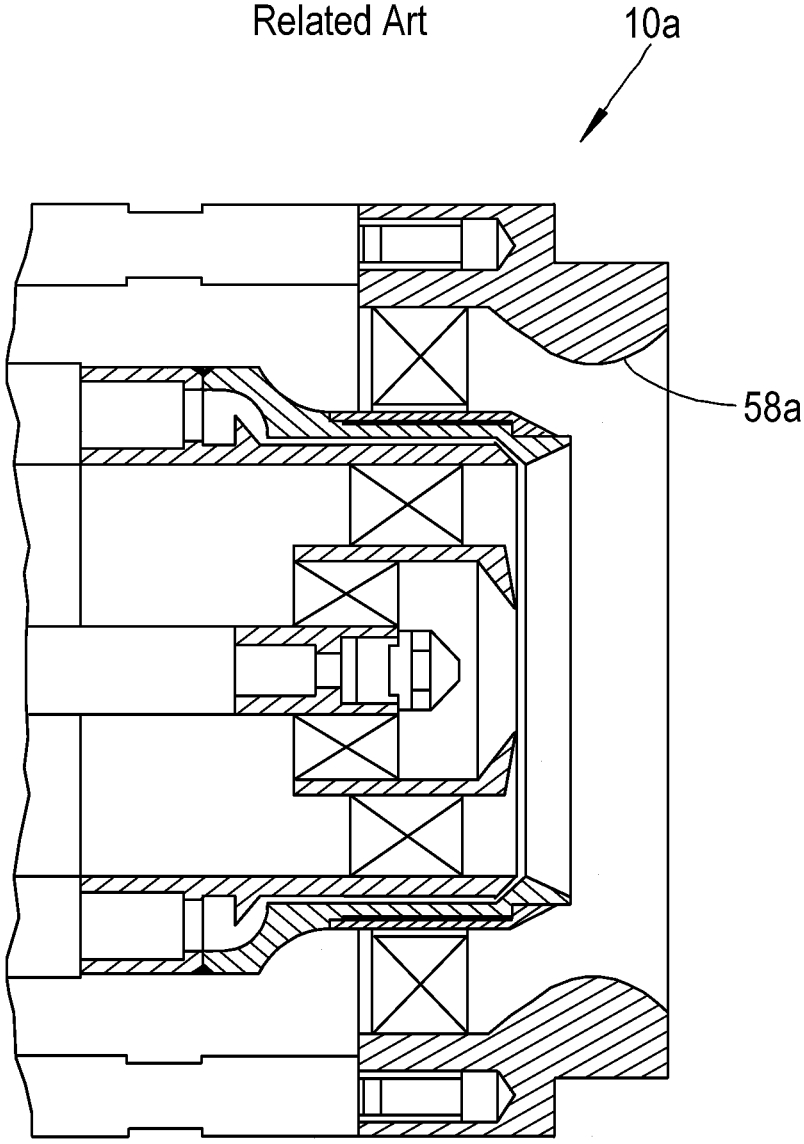
Fig.6 Related Art
FIG. 6 shows a longitudinal cross-section through a known fuel injection system.

This geometry of the outer wall is in contrast to that of known fuel injection systems, such as the system 10*a* shown in FIG. 6, in which the part of the outer wall 58*a* lying downstream of the mains fuel injector flares outwardly in the downstream direction.

By configuring the outer wall 58 according to the embodiment of the present invention, the velocity of the mains fuel air stream at exit from the fuel injection system 10 is increased and the cone angle of the frustoconical mains fuel spray stream is decreased. As a result, a high shear flow is created around the outer surface of the mains fuel spray stream. In effect, a recirculation zone 110 is formed that is bounded by the outer surface of the frustoconical mains fuel spray stream, the upstream wall 12 of the combustion chamber and the inner surface of the flame tube 14. The fuel injected into this region of high shear flow evaporates quickly and then reacts, so that a flame front is formed on the outer surface of the mains fuel spray stream.

Thus, a flame front is achieved not only on a radially inner surface of the mains fuel spray stream, as is the case for known fuel injection systems, but also on a radially-spaced outer surface of the mains fuel spray stream. In effect, a double flame front 100,102 is achieved, resulting in an improvement in combustion efficiency and a reduction in the amount of unburned fuel lining the inner surface of the flame tube 14.

FIGS. 2*a*, 3*a*, 4*a*, and 5*a* show the results of three-dimensional CFD modelling of fluid flow and combustion using the fuel injection system of FIG. 1. FIGS. 2*b*, 3*b*, 4*b*, and 5*b* show the results of comparative three-dimensional CFD modelling using a reference fuel injection system.

Figure 2A:
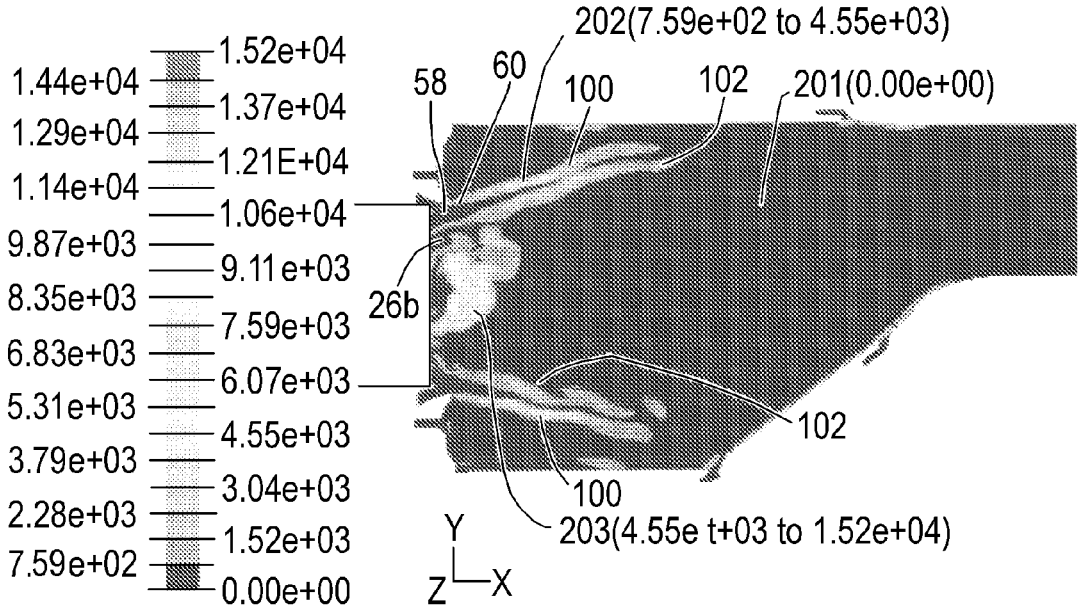
FIG. 2*a* shows the modelled product formation rate in a longitudinal cross-section of a combustion chamber fitted with the fuel injection system of the first embodiment of the invention.

The double flame front may be seen in FIG. 2*a*. This Figure shows an outer reaction front 100 (region of high product formation rate) streaming from the outermost extremity of the outer mains swirler 24 i.e. from the raised ring 60 at the downstream extremity of the outer wall 58. An inner reaction front 102 (region of high product formation rate) is directed into the flame tube from the innermost extremity of the inner mains swirler 22 i.e. from the downstream extremity of the flared portion 26*b* of the air splitter 26.

Figure 2B:
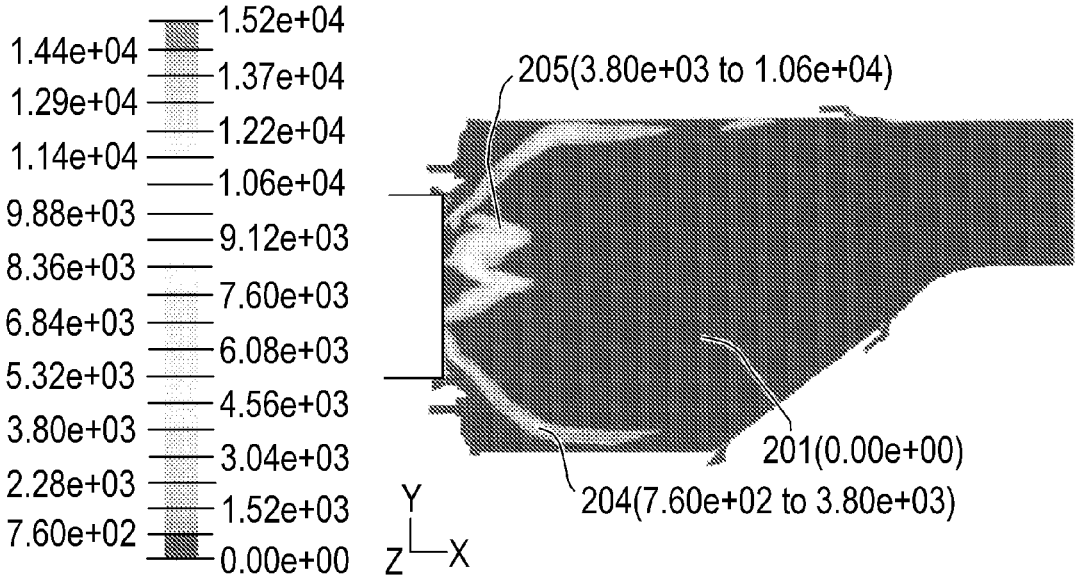
FIG. 2*b* shows the modelled product formation rate in a longitudinal cross-section of a combustion chamber fitted with a reference fuel injection system.

By contrast, the reference fuel injection system modelled in FIG. 2*b* shows only a reaction front extending from the innermost extremity of the inner mains swirler i.e. from the radially outermost tip of the air splitter. No reaction front is observed extending from the radially outermost regions of the outer mains swirler.

The result of the double flame front achieved in the fuel injection system of the present embodiment is that combustion of the fuel takes place on both the radially inner and radially outer surfaces of the frustoconical mains fuel spray stream. This may be seen in FIG. 3*a*, which shows the progress variable of the reaction as a function of position within the flame tube. The progress variable indicates the extent of reaction of the fuel/air mixture: a high progress variable indicates that the reaction is largely complete, while a low progress variable indicates that a high level of unburnt fuel remains.

Figure 3A:
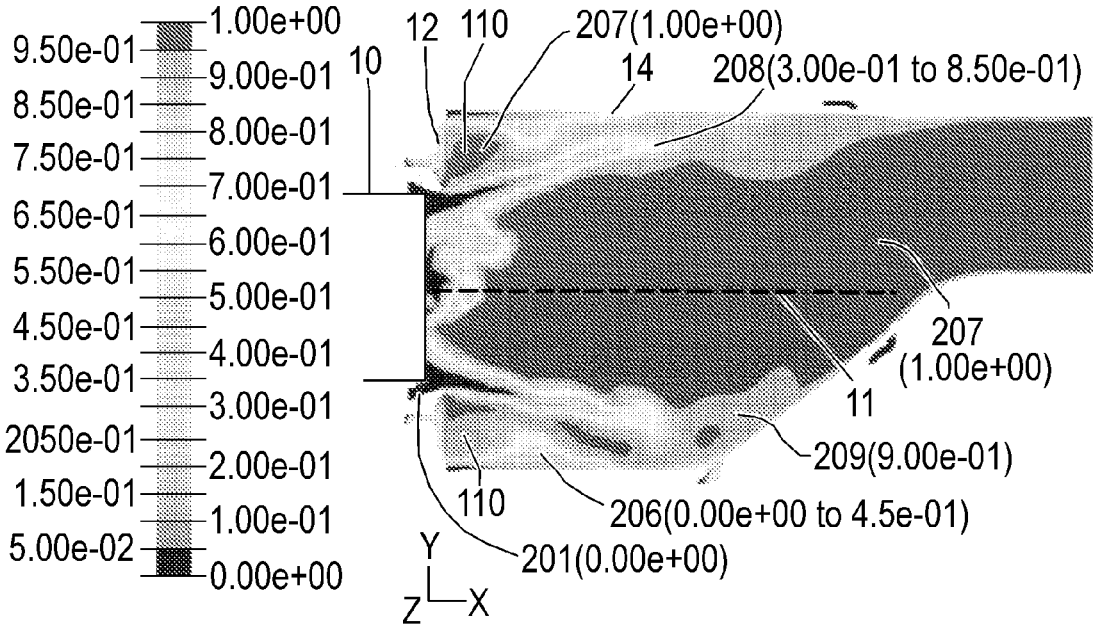
FIG. 3*a* shows the modelled progress variable of a combustion reaction in a longitudinal cross-section of a combustion chamber fitted with the fuel injection system of the first embodiment of the invention.

FIG. 3*a* displays two distinct regions of almost fully reacted fuel, the first being around the central axis 11 of the fuel injector system 10 and so extending inwardly of the frustoconical mains fuel spray stream, and the second lying along the inner surface of the flame tube 14 and therefore extending from the outer surface of the mains fuel spray stream. Thus, high levels of fuel combustion are observed within the regions of the flame tube 14 lying closest to the upstream wall 12 of the combustion chamber.

FIG. 3*a* also shows that the recirculation zone 110 is formed close to the heatshield of the upstream wall 12 of the combustion chamber by the high shear flow on the outer surface of the mains fuel spray stream. The high shear flow allows the fuel to evaporate faster and hence promotes efficient combustion of the fuel.

Figure 3B:
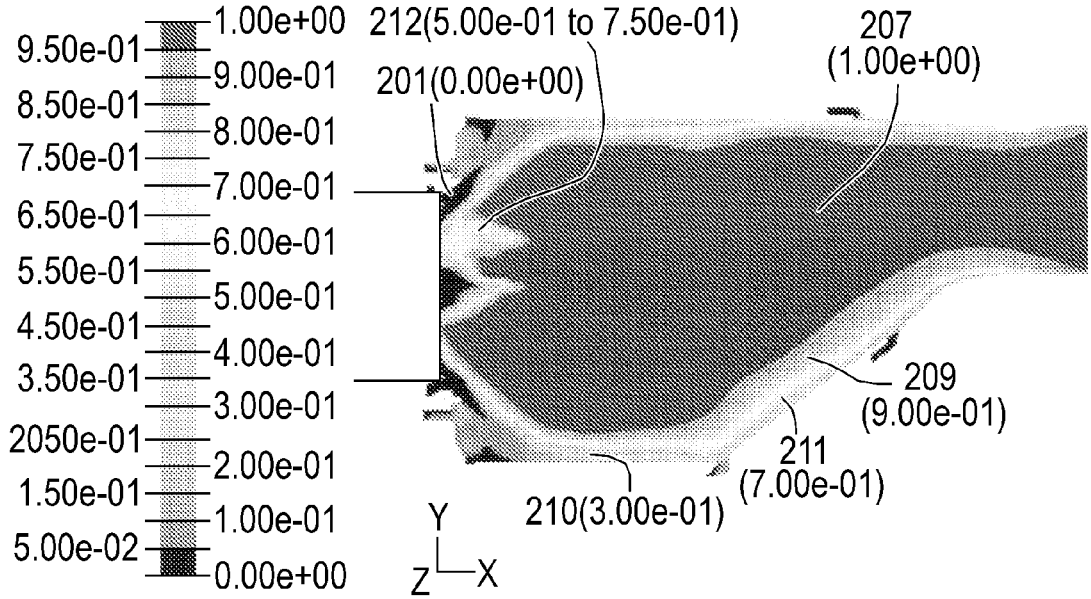
FIG. 3*b* shows the modelled progress variable of a combustion reaction in a longitudinal cross-section of a combustion chamber fitted with a reference fuel injection system.

By contrast, the reference fuel injection system modelled in FIG. 3*b* displays only one region of almost fully reacted fuel, which extends along the central axis of the fuel injection system. Only low levels of reaction of the fuel are observed adjacent to the upstream wall of the combustion chamber.

Figure 4A:
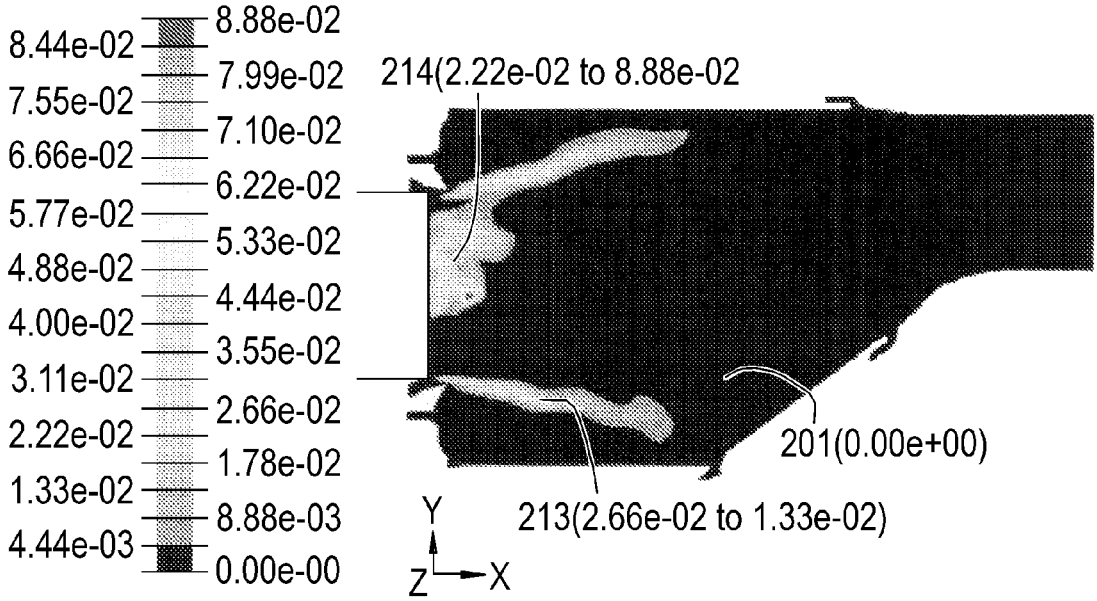
FIG. 4*a* shows the modelled mass fraction of C12H23 in a longitudinal cross-section of a combustion chamber fitted with the fuel injection system of the first embodiment of the invention.

As a result of the higher levels of combustion of the fuel within the flame tube, the levels of unburnt fuel produced by the fuel injection system of this embodiment of the present invention are substantially lower than for known fuel injection systems. This effect may be seen in FIGS. 4*a* and 4*b*. FIG. 4*a* shows that for the fuel injection system of this embodiment of the present invention, the unburnt fuel is concentrated close to the downstream end of the pilot fuel injector and in a stream corresponding to the frustoconical mains fuel spray stream. Such fuel will eventually evaporate and react.

Figure 4B:
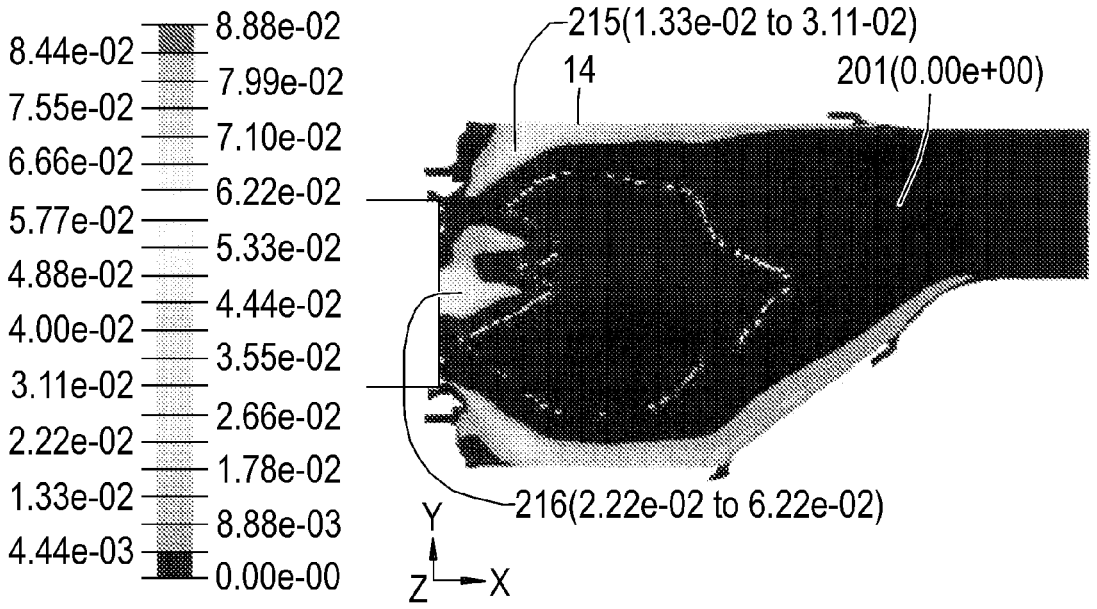
FIG. 4*b* shows the modelled mass fraction of C12H23 in a longitudinal cross-section of a combustion chamber fitted with a reference fuel injection system.

By contrast, in the reference fuel injection system modelled in FIG. 4*b*, significant amounts of unburnt fuel are observed along the inner surface of the flame tube 14. This unburnt fuel does not react and is either deposited on the inner surface of the flame tube or is emitted in the unburnt state by the combustor.

Hence, the fuel injection system of this embodiment of the invention demonstrates improved performance through a reduction in emissions of undesirable compounds such as carbon monoxide and unburnt hydrocarbons.

Figure 5A:
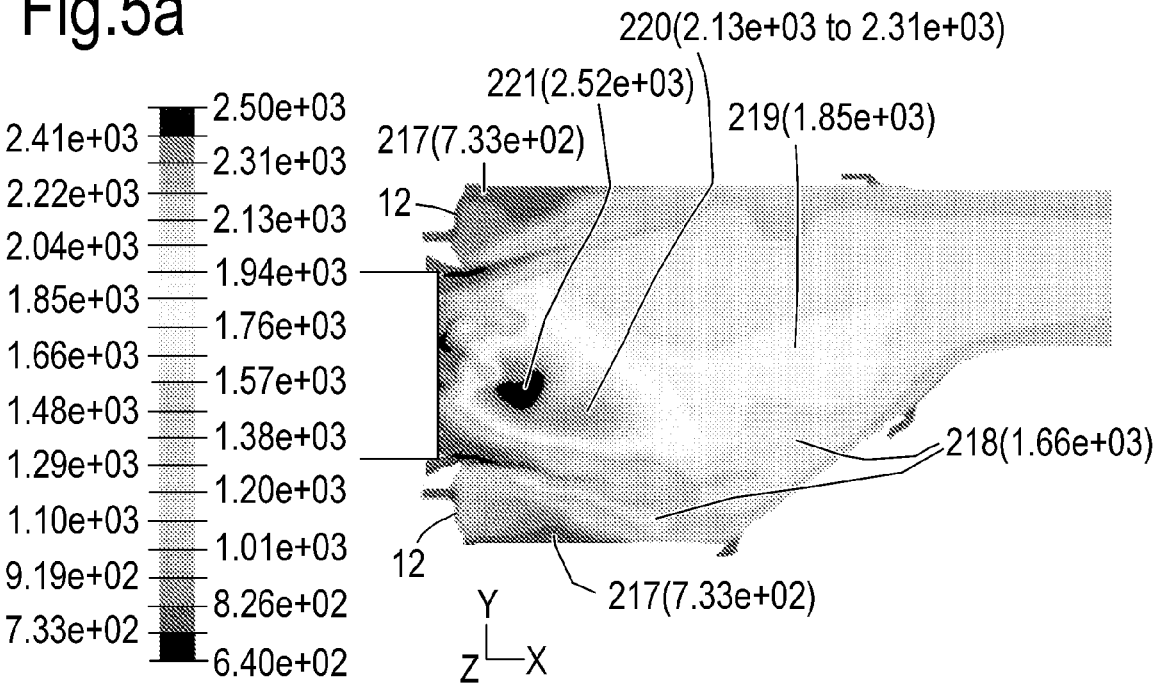
FIG. 5*a* shows the modelled temperature in a longitudinal cross-section of a combustion chamber fitted with the fuel injection system of the first embodiment of the invention.
Figure 5B:
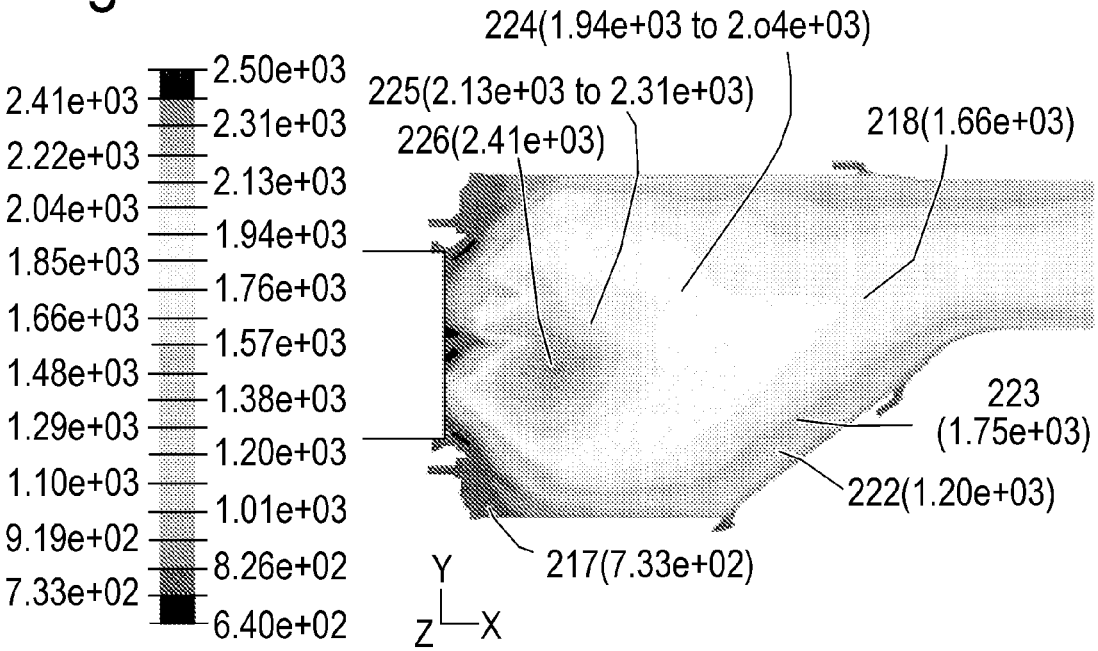
FIG. 5*b* shows the modelled temperature in a longitudinal cross-section of a combustion chamber fitted with a reference fuel injection system.

Due to the higher levels of fuel combustion within the flame tube in the fuel injection system of this embodiment of the invention, higher temperature levels are observed within the flame tube, compared to those observed in known fuel injection system. This may be seen from a comparison of FIG. 5*a*, showing the temperature distribution in an embodiment of the present invention, with FIG. 5*b*, showing the temperature distribution in the reference fuel injection system. In particular, regions of high temperature are observed close to the upstream wall 12 of a combustion chamber fitted with the fuel injection system of this embodiment of the invention. These high-temperature regions denote recirculation regions in which the high shear experienced by the outer surface of the mains fuel spray stream results in rapid evaporation and reaction of the fuel.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A fuel injection system for a gas turbine, comprising:

a mains airblast fuel injector having an annular shape;

an inner mains swirler for swirling air past said mains airblast fuel injector, said inner mains swirler being concentric with said mains airblast fuel injector and being located radially inward of said mains airblast injector; and an outer mains swirler for swirling air past said mains airblast fuel injector, said outer mains swirler being concentric with said mains airblast fuel injector and being located radially outward of said mains airblast injector, and said outer mains swirler being bounded at its outermost radial extent by an annular outer wall, which is concentric with said mains airblast fuel injector, a portion of said outer wall extending beyond said outer mains swirler to lie downstream of said mains airblast fuel injector;

wherein the portion of said outer wall lying downstream of said mains airblast fuel injector tapers radially inwardly in the downstream direction; and said fuel injection system is mounted in an upstream wall of a combustion chamber, said tapered portion of said outer wall extending to said upstream wall.

2. The fuel injection system of claim 1, wherein said tapered portion meets said upstream wall at an annular ring that protrudes from said upstream wall in a downstream direction.

3. The system of any one of claim 1, wherein on a section through the system containing the central axis of the fuel injection system, said tapered portion of said outer wall is at an angle in the range of from 0° to 50° to said central axis.

4. The fuel injection system of claim 1, further comprising a pilot fuel injector lying radially inward of said mains fuel injector.

5. The system of claim 1, wherein the swirl angle of the mains inner swirler is in the range of from 20° to 50°.

6. The system of claim 1, wherein the swirl angle of the mains outer swirler is in the range of from 40° to 70°.

7. A lean burn combustor having a fuel injection system comprising:

a mains airblast fuel injector having an annular shape;

an inner mains swirler for swirling air past said mains airblast fuel injector, said inner mains swirler being concentric with said mains airblast fuel injector and being located radially inward of said mains airblast injector;

an outer mains swirler for swirling air past said mains airblast fuel injector, said outer mains swirler being concentric with said mains airblast fuel injector and being located radially outward of said mains airblast injector;

said outer mains swirler being bounded at its outermost radial extent by an annular outer wall, which is concentric with said mains airblast fuel injector, a portion of said outer wall extending beyond said outer mains swirler to lie downstream of said mains airblast fuel injector;

wherein the portion of said outer wall lying downstream of said mains airblast fuel injector tapers radially inwardly in the downstream direction; and said fuel injection system is mounted in an upstream wall of a combustion chamber, said tapered portion of said outer wall extending to said upstream wall.

8. A gas turbine engine comprising, in flow series:

an inlet, a fan, a core engine having a compressor, a combustor with a combustion chamber, a fuel injection system for delivering fuel to said combustion chamber, said fuel injection system having a mains airblast fuel injector having an annular shape;

an inner mains swirler for swirling air past said mains airblast fuel injector, said inner mains swirler being concentric with said mains airblast fuel injector and being located radially inward of said mains airblast injector; and an outer mains swirler for swirling air past said mains airblast fuel injector, said outer mains swirler being concentric with said mains airblast fuel injector and being located radially outward of said mains airblast injector, and said outer mains swirler being bounded at its outermost radial extent by an annular outer wall, which is concentric with said mains airblast fuel injector, a portion of said outer wall extending beyond said outer mains swirler to lie downstream of said mains airblast fuel injector;

wherein the portion of said outer wall lying downstream of said mains airblast fuel injector tapers radially inwardly in the downstream direction; and said fuel injection system is mounted in an upstream wall of said combustion chamber, said tapered portion of said outer wall extending to said upstream wall a turbine, and an exhaust, wherein the fan, compressor, and turbine are all arranged to rotate about a central common engine axis.

* * * * *